US012495922B2

(12) United States Patent
Smith

(10) Patent No.: US 12,495,922 B2
(45) Date of Patent: Dec. 16, 2025

(54) COMBINED CURTAIN ROD AND MOUNTING PLATE SYSTEM

(71) Applicant: Beth Smith, Pottsville, PA (US)

(72) Inventor: Beth Smith, Pottsville, PA (US)

( * ) Notice: Subject to any disclaimer, the term of this patent is extended or adjusted under 35 U.S.C. 154(b) by 0 days.

(21) Appl. No.: 18/800,262

(22) Filed: Aug. 12, 2024

(65) Prior Publication Data

US 2025/0064247 A1 Feb. 27, 2025

Related U.S. Application Data

(60) Provisional application No. 63/578,441, filed on Aug. 24, 2023.

(51) Int. Cl.
*A47H 1/142* (2006.01)

(52) U.S. Cl.
CPC ..... *A47H 1/142* (2013.01)

(58) Field of Classification Search
CPC . A47H 1/142; A47H 1/14; A47H 1/12; A47H 1/122; A47H 1/10; A47H 1/02; A47H 1/022
USPC ..... 211/105.1, 123, 105.3; 248/251
See application file for complete search history.

(56) References Cited

U.S. PATENT DOCUMENTS 1,045,898 A 12/1912 Shaw
1,074,825 A 10/1913 Walsh
1,206,769 A * 11/1916 Wheary ..... E05B 69/006 211/94.02
1,428,972 A 9/1922 Newell
2,653,718 A * 9/1953 Woodward ..... A47H 1/122 211/105.2
3,095,033 A * 6/1963 Polkosnik ..... A47H 1/122 248/265
4,316,547 A * 2/1982 Varon ..... A47G 25/0692 211/124
4,360,109 A * 11/1982 Kurtz ..... D06F 57/12 211/100
4,824,062 A * 4/1989 Wagner ..... A47H 1/142 248/265
4,915,343 A * 4/1990 Terlecke ..... A47H 1/14 411/908
5,373,950 A * 12/1994 Marc ..... D06F 57/12 211/88.04
5,415,299 A * 5/1995 Usner ..... B65G 9/008 224/313

(Continued)

FOREIGN PATENT DOCUMENTS

DE 202005013679 U1 * 11/2005 ..... A47H 1/00

*Primary Examiner* — Jennifer E. Novosad
(74) *Attorney, Agent, or Firm* — Brennan, Manna & Diamond, LLC

(57) ABSTRACT

A curtain hanging system that includes a mounting plate with a front and rear surface, equipped with multiple apertures for securing the plate to a wall using various mechanical fasteners. A pair of symmetrical L-brackets are integrated to the front surface of the plate, each bracket includes a planar member affixed to the mounting plate and a transverse member that extends outwardly from the mounting plate. A rod member is attached to each transverse member and extends parallel to the plate and beyond the mounting plate's end. The rod members are designed to support curtains, enabling for their attachment and removal without the need to disassemble the rod from the mounting plate.

20 Claims, 3 Drawing Sheets

(56) References Cited

U.S. PATENT DOCUMENTS

| | | | | |
|---|---|---|---|---|
| 6,145,677 | A * | 11/2000 | Corniel | D06F 95/00 211/113 |
| 6,499,186 | B1 * | 12/2002 | Arentsen | A47H 5/08 160/335 |
| 7,648,111 | B2 * | 1/2010 | Goldstein | A47H 1/142 248/200.1 |
| 8,418,975 | B1 * | 4/2013 | Burr | A47H 1/142 248/261 |
| 8,469,207 | B2 * | 6/2013 | Rowan | A47H 1/102 211/124 |
| 8,479,931 | B1 * | 7/2013 | Richards | A47H 1/142 211/105.2 |
| 9,763,529 | B2 * | 9/2017 | Abebe | A47G 29/08 |
| 10,206,523 | B2 * | 2/2019 | Abebe | F16B 7/22 |
| 10,278,529 | B2 * | 5/2019 | Baines | A47H 1/122 |
| 2005/0218283 | A1 * | 10/2005 | Goldstein | A47H 1/142 248/251 |
| 2006/0021722 | A1 * | 2/2006 | Nien | A47H 1/142 160/330 |
| 2008/0148526 | A1 | 6/2008 | Garcia | |
| 2015/0265086 | A1 * | 9/2015 | Hanley | A47H 1/122 248/265 |
| 2016/0073813 | A1 * | 3/2016 | Cheng | F16B 45/00 248/262 |
| 2021/0100388 | A1 * | 4/2021 | James | A47H 1/142 |
| 2025/0064247 | A1 * | 2/2025 | Smith | A47H 1/142 |

* cited by examiner

COMBINED CURTAIN ROD AND MOUNTING PLATE SYSTEM

CROSS-REFERENCE TO RELATED APPLICATION

The present application claims priority to, and the benefit of, U.S. Provisional Application No. 63/578,441, which was filed on Aug. 24, 2023, and is incorporated herein by reference in its entirety.

FIELD OF THE INVENTION

The present invention generally relates to the field of curtain holders. More specifically, the present invention relates to a novel curtain mount and hanging system. The system includes an integrated curtain rod and a mounting plate. The rod is attached to the plate using a pair of symmetrical L-brackets, each bracket comprises a vertical planar member affixed to the mounting plate and a horizontal transverse member that extends outward. The rod includes two rod members which are designed to support curtains, enabling for their attachment and removal without the need to disassemble the rod from the mounting plate. Accordingly, the present disclosure makes specific reference thereto. Nonetheless, it is to be appreciated that aspects of the present invention are also equally applicable to other like applications, devices, and methods of manufacture.

BACKGROUND

By way of background, curtains are commonly used for functional purposes and aesthetics in living spaces and other indoor spaces. Curtains add color, texture, and pattern to a room, enhancing the overall design and ambiance. Curtains also enable for the control of natural light entering a room. Depending on the material, curtains can block out light completely for darkness and privacy or filter light to create a soft ambient atmosphere. Curtains can help dampen noise from the outside, thereby creating a quieter and more peaceful living environment.

Curtains are hung using curtain rods which provide the necessary support for hanging curtains. The design and finish of the rods themselves can also contribute to the overall design aesthetic of a room. Standard curtain rods can adequately support curtains in most cases. However, conventional curtain rods can be inefficient and may break easily leading to repeated replacements and maintenance. Commonly, the conventional curtain rods can become loose. Loose curtain rods can damage the windowsills and may cause the curtains to drop on the floor. Damage to the windowsills can be due to constant movement or adjustment of the rods.

If a curtain rod bends, the rod loses the ability thereof to function properly. A bent rod can lead to uneven hanging of curtains, difficulty in sliding the curtains open or closed, and an overall unappealing appearance. Further, the process of changing traditional curtain rods is frustrating and time-consuming. A user needs to remove the entire rod, hang the curtains, and then reinsert the rod into the supporting hardware. The process can be cumbersome, especially in cases where the rods are prone to damage easily. Individuals desire a novel curtain mount and hanging system for supporting curtains that can overcome the challenges associated with conventional curtain rods.

Therefore, there exists a long felt need in the art for an improved curtain mounting system. There is also a long felt need in the art for a modified curtain mount and hanging system that makes changing and hanging curtains quicker, safer, and much easier. Additionally, there is a long felt need in the art for a combined mounting plate and curtain rod system that obviates removing or uninstalling curtain rods for removing and installing curtains. Moreover, there is a long felt need in the art for a curtain mounting system that keeps curtain rod safe and rigid. Further, there is a long felt need in the art for a curtain mounting system that can be used with any type of curtain. Furthermore, there is a long felt need in the art for an improved curtain hanging system that can be customized, has minimal loose parts, and can be installed anywhere indoors. Finally, there is a long felt need in the art for a novel curtain hanging system that simplifies the installation and customization of curtain rods.

The subject matter disclosed and claimed herein, in one embodiment thereof, comprises a curtain hanging system. The system includes a generally rectangular mounting plate that has a rear surface, a front surface, and a planar member formed therebetween, wherein the planar member includes a plurality of apertures for mounting the plate to a wall using fasteners. A first L-bracket and a second L-bracket are attached to the front surface of the mounting plate, preferably near the middle of the plate, each bracket includes a planar rectangular member affixed to the front surface of the mounting plate and a transverse member that extends outwardly from the mounting plate. A curtain rod is included and comprises a first rod member and a second rod member, each rod member is attached to a respective transverse member of the first and second L-brackets. The curtain rod is configured to hang at least one curtain without requiring removal of the rod from the mounting plate wherein the grommets or hooks of a curtain are passed through the attachments of the rod members.

In this manner, the curtain hanging system of the present invention accomplishes all of the forgoing objectives and provides users with a novel system that utilizes a one-piece mounting plate with multiple apertures, simplifying the installation process. The integration of L-brackets directly onto the mounting plate reduces the number of separate components needed, minimizing potential for loose parts, and ensuring a more secure attachment of the curtain rod. Using the system, curtains can be hung or removed easily by sliding them onto the rod members, even without detaching the rod from the brackets.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a curtain hanging system. The system further comprises a mounting plate having a rear surface, a front surface, and a planar member formed therebetween, wherein the planar member includes a plurality of apertures. A first L-bracket and a second L-bracket are attached to the front surface of the mounting plate, each bracket includes a planar rectangular member affixed to the front surface of the mounting plate and a transverse member that extends outwardly from the mounting plate. A curtain rod is included and comprises a first rod member and a second rod member, each rod member is attached to a respective transverse member of the first and second L-brackets. The curtain rod is configured to hang at least one curtain without requiring removal of the rod from the mounting plate.

In yet another embodiment, a combined curtain rod and mounting plate system is disclosed. The system comprises a generally rectangular mounting plate having a plurality of apertures positioned at the midpoint of the top and bottom edges of the mounting plate, a first and a second symmetrical L-bracket, each bracket includes a welded planar rectangular member and a transverse member, the transverse members extend parallel to each other from the front surface of the mounting plate, a curtain rod is composed of two transparent rod members, each curtain rod member is attached to a respective transverse member of the L-brackets and extends beyond the ends of the mounting plate, and detachable aesthetic attachments are located at the free ends of the rod members, facilitating easy customization of the system's appearance.

In another aspect, the curtain is hung on the rod members by passing grommets through the rod members and aesthetic attachments without detaching the curtain rod from the mounting plate.

In yet another aspect, the curtain rod members are attached to the outer surfaces of the transverse members of the L-brackets and extend parallel to the mounting plate and capable of supporting at least one curtain.

In yet another embodiment, the rod members and the mounting plate are made from a transparent material, enabling for aesthetic integration into various room decors.

In a further embodiment, the apertures are disposed at any position on the mounting plate to accommodate different mounting requirements.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
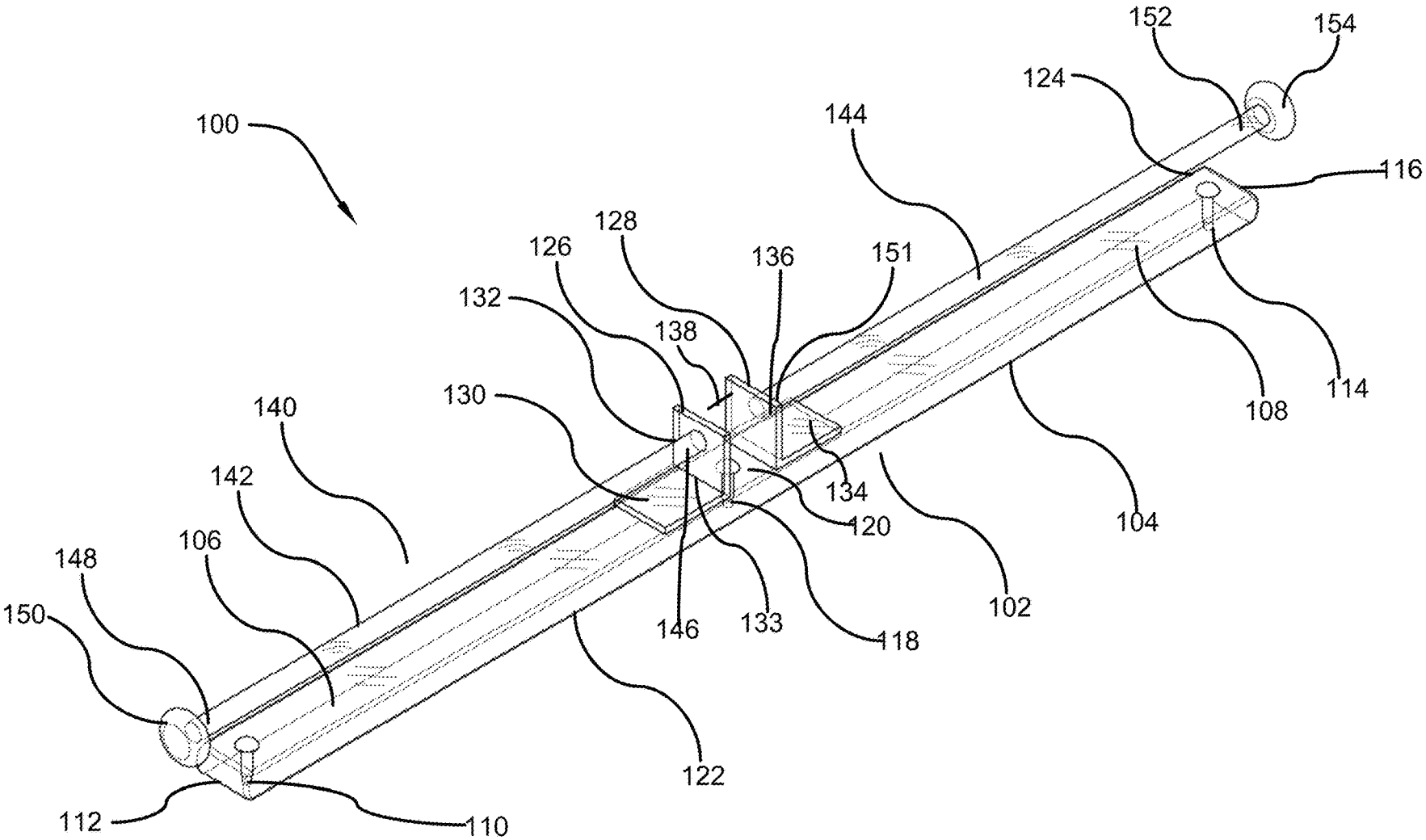
FIG. 1 illustrates a perspective view of the combined mount and curtain rod device of the present invention in accordance with one embodiment of the disclosed structure.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for an improved curtain mounting system. There is also a long felt need in the art for a modified curtain mount and hanging system that makes changing and hanging curtains quicker, safer, and much easier. Additionally, there is a long felt need in the art for a combined mounting plate and curtain rod system that obviates removing or uninstalling curtain rods for removing and installing curtains. Moreover, there is a long felt need in the art for a curtain mounting system that keeps curtain rod safe and rigid. Further, there is a long felt need in the art for a curtain mounting system that can be used with any type of curtain. Furthermore, there is a long felt need in the art for an improved curtain hanging system that can be customized, has minimal loose parts, and can be installed anywhere indoors. Finally, there is a long felt need in the art for a novel curtain hanging system that simplifies the installation and customization of curtain rods.

The present invention, in one exemplary embodiment, is a curtain hanging system. The system further comprises a mounting plate having a rear surface, a front surface, and a planar member formed therebetween, wherein the planar member includes a plurality of apertures. A first L-bracket and a second L-bracket are attached to the front surface of the mounting plate, each bracket includes a planar rectangular member affixed to the front surface of the mounting plate and a transverse member that extends outwardly from the mounting plate. A curtain rod is included and comprises a first rod member and a second rod member, each rod member is attached to a respective transverse member of the first and second L-brackets. The curtain is hung on the rod members by passing grommets through the rod members and aesthetic attachments without detaching the curtain rod from the mounting plate.

Referring initially to the drawings, FIG. 1 illustrates a perspective view of the combined mount and curtain rod device of the present invention in accordance with one embodiment of the disclosed structure. The combined mount and curtain rod device 100 of the present invention is designed as a curtain hanging system that offers both functional improvements and aesthetic benefits over conventional curtain rod systems. More specifically, the curtain hanging system 100 includes a one-piece construction or structure that reduces the complexity in installing a curtain. The combined mount and curtain rod device 100 includes a mount or mounting plate 102 which is generally rectangular. The mounting plate 102 has a rear surface 104 and an opposite front surface 106 forming a planar member 108 of the mounting plate 102. The mounting plate 102 includes at least one aperture 110 disposed through the planar member 108 near the first end 112 of the mounting plate 102. Another at least one aperture 114 is disposed through the planar member 108 near the opposite second end 116 of the mounting plate 102. A central aperture 118 is disposed at the center 120 of the mounting plate 102.

The apertures 110, 114, 118 are adapted to receive a mechanical screw or nail (i.e., fasteners) therethrough respectively for securely mounting the mounting plate 102 to a wall such as above a window. The apertures 110, 114, 118 can be designed and disposed to receive different mechanical screws (i.e., fasteners) to fasten or mount the mounting plate 102 to a wall. The apertures 110, 114, 118 are preferably disposed at midpoint of the top edge 122 and the bottom edge 124 of the mounting plate 102. In different embodiments, the apertures 110, 114, 118 can be disposed at any position on the mounting plate 102 to accommodate different mounting requirements of the users.

A first L-bracket 126 is integrated on one side of the central aperture 118 and a second symmetrical L-bracket 128 is integrated on the opposite side of the central aperture 118. The first L-bracket 126 has a first planar rectangular member 130 adhered to the front surface 106 of the mounting plate 102 and a second planar rectangular member 132 which is transverse to the first planar rectangular member 130 extends transversely and outwardly from the front surface 106 of the mounting plate 102. The first planar rectangular member 130 can be welded or affixed using an adhesive to the mounting plate 102. The members 130, 132 are joined along the common edge 133.

The second L-bracket 128 has a first planar rectangular member 134 integrated and adhered to the front surface 106 of the mounting plate 102. A transverse second member 136 extends transversely and outwardly from the first member 134 and is positioned parallel to the transverse member 132 of the first L-bracket 126. The gap or space 138 between the transverse members 132, 136 is used for fastening a screw through the central aperture 118.

A rod 140 is included in the combined mount and curtain rod device 100 for hanging at least one curtain thereon. The rod 140 includes a first rod member 142 and a second rod member 144. The first rod member 142 is attached to the outer surface 146 of the transverse member 132 of the first L-bracket 126 and extends parallel to the mounting plate 102. The free end 148 of the first rod member 142 extends beyond the end 112 of the mounting plate 102. The free end 148 of the first rod member has a detachably attached to an aesthetic attachment 150 which can be replaced to change the appearance of the system 100.

The second rod member 144 is attached to the outer surface 151 of the transverse member 136 of the second L-bracket 128 and extends parallel to the mounting plate 102. The free end 152 of the second rod member 144 extends beyond the end 116 of the mounting plate 102. A corresponding aesthetic attachment 154 which can be same or different from the attachment 150 is disposed on the free end 152 of the second rod member 144.

The rod members 142, 144 and the aesthetic attachments 150, 154 are narrow enough enabling a curtain to be easily hung on the curtain rod 140 by passing the grommets through the rod members 142, 144 and the attachments 150, 154 without removing the curtain rod 140 from the mounting plate 102.

The integrated structure of the curtain rod 140 and the mounting plate 102 makes changing and hanging curtains quicker, safer, and much easier than using traditional curtain rods. The rod members 142, 144 are preferably transparent and in some embodiments, the mounting plate 102 can also be transparent.

Figure 2:
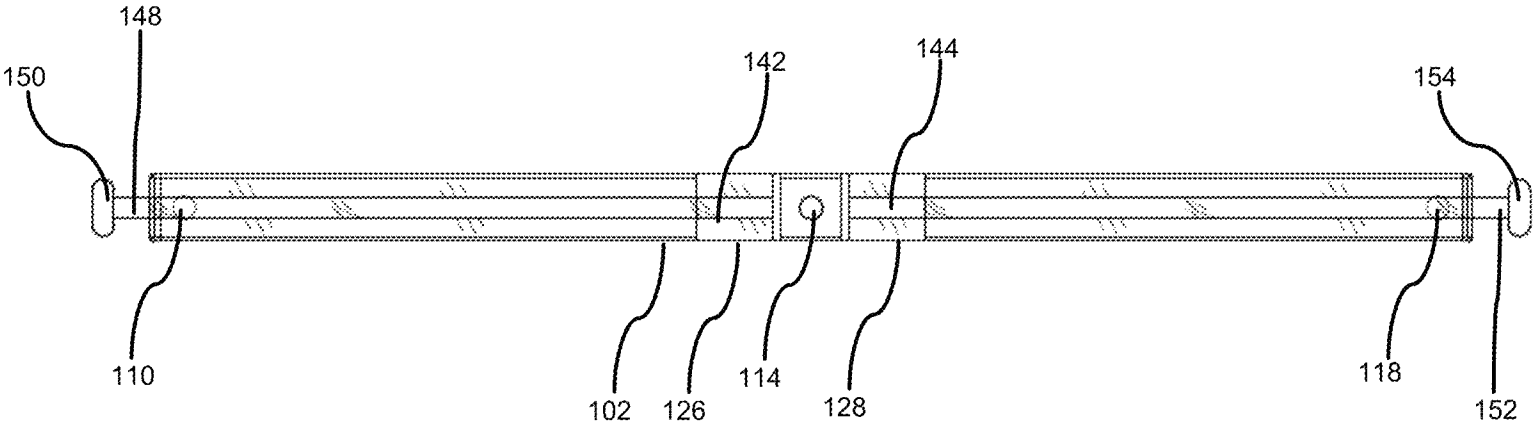
FIG. 2 illustrates a top perspective view of the combined curtain rod and mounting plate device of the present invention in accordance with the disclosed structure.

FIG. 2 illustrates a top perspective view of the combined curtain rod and mounting plate device of the present invention in accordance with the disclosed structure. As illustrated, the mounting plate 102 is wider than the curtain rod members 142, 144. The rod length 140 extends beyond the opposite ends 112, 116 of the mounting plate 102. The rod members 142, 144 do not overlap the central aperture 118, thereby providing easy access of the aperture 118 for mounting the mounting plate 102.

In some embodiments, the apertures 110, 114, 118 can be positioned at any desired position on the mounting plate and in some embodiments, the rear surface 104 may have an adhesive layer for mounting the plate 102.

Figure 3:
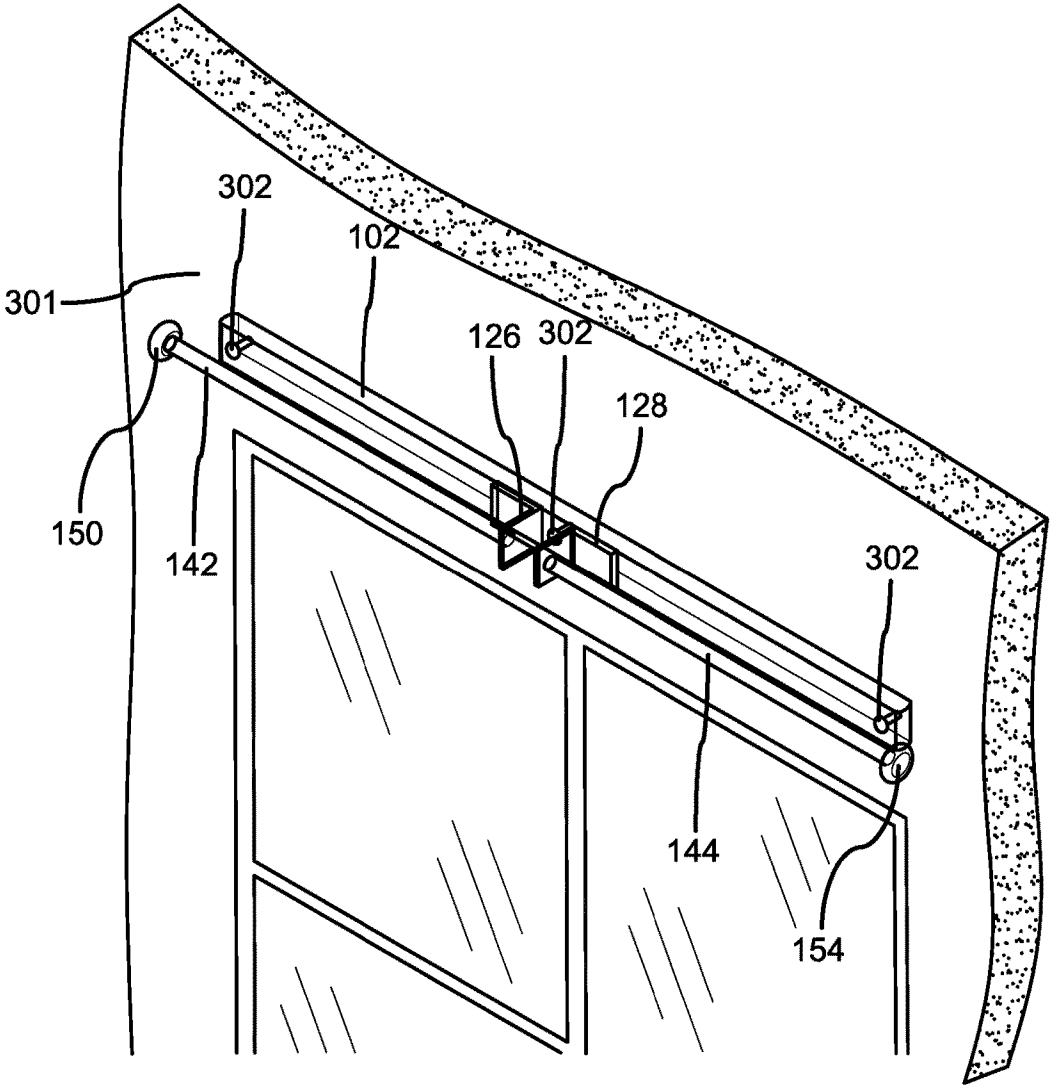
FIG. 3 illustrates a perspective view showing the integrated curtain rod and mounting plate device of the present invention installed above a window on a wall in accordance with the disclosed structure.

FIG. 3 illustrates a perspective view showing the integrated curtain rod and mounting plate device of the present invention installed above a window on a wall in accordance with the disclosed structure. The device 100 is mounted such that the mounting plate 102 adheres to the wall 301 and the rod 140 is positioned in front of the mounting plate 102, thereby enabling easy access of the rod 140 to a user. The mounting plate 102 is mounted using the screws (i.e., fasteners) 302 which are accommodated using the apertures 110, 114, 118. The screws (i.e., fasteners) 302 can be drilled or tapped as per requirements of the users.

A curtain 306 can be mounted on the second rod member 144 (shown as example) with the grommets or hooks (i.e., hangers) 304 passing through attachment 154 and the rod member 144 as shown by arrow "C". Similarly, a second curtain can be mounted to the first rod member 142 by passing through the corresponding attachment 150. It will be apparent to a person skilled in the art that the curtains can be installed or removed without removing the curtain rod members 142, 144 from the mounting plate 102, thus making the process smoother and quicker. The L-brackets 126, 128 providing adequate support to the corresponding rod members 142, 144, thereby obviating loosening and bending of the rod members 142, 144. The attachments 150, 154 can be easily detached (i.e., selectively attachable) and replaced with attachments of different designs.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "combined mount and curtain rod device", "curtain hanging system", "integrated curtain rod and mounting plate device", "system", and "device" are interchangeable and refer to the combined mount and curtain rod device 100 of the present invention.

Notwithstanding the forgoing, the combined mount and curtain rod device 100 of the present invention can be of any suitable size and configuration as is known in the art without affecting the overall concept of the invention, provided that it accomplishes the above stated objectives. One of ordinary skill in the art will appreciate that the combined mount and curtain rod device 100 as shown in the FIGS. are for illustrative purposes only, and that many other sizes and shapes of the combined mount and curtain rod device 100 are well within the scope of the present disclosure. Although the dimensions of the combined mount and curtain rod device 100 are important design parameters for user convenience, the combined mount and curtain rod device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A combined mount and curtain rod device comprising:
a mounting plate having a rear surface and an opposing front surface including at least three apertures;
at least three fasteners;
a first L-bracket;
a second L-bracket;
a first rod member; and
a second rod member;
wherein at least one aperture of the at least three apertures disposed through said mounting plate proximal to a first end, at least a second aperture of the at least three apertures disposed through said mounting plate proximal to a second end, and a third aperture of the at least three apertures disposed proximal to a center of said mounting plate;
wherein each one of said at least three apertures having at least one of said at least three fasteners therethrough for mounting said mounting plate to a wall;
wherein said first L-bracket mounted proximal to a first side of said third aperture and said second L-bracket mounted proximal to an opposing side of said third aperture;
wherein said first L-bracket having a first planar member affixed to said front surface of said mounting plate;
wherein said first L-bracket having a second planar member transverse to said first planar member extending transversely and outwardly from said front surface of said mounting plate;
wherein said second L-bracket having a third planar member affixed to said front surface of said mounting plate;
wherein said second L-bracket having a fourth planar member transverse to said third planar member extending transversely and outwardly from said front surface of said mounting plate;
wherein said second planar member and said fourth planar member having a space therebetween;
wherein said first rod member at a first end attached to said second planar member of said first L-bracket and extends parallel to said mounting plate; and
further wherein said second rod member at a first end attached to said fourth planar member of said second L-bracket and extends parallel to said mounting plate.

2. The combined mount and curtain rod device of claim 1, wherein said first rod member at a second end is a free terminal end for receiving a plurality of curtain hangers.

3. The combined mount and curtain rod device of claim 2, wherein said second rod member at a second end is a free terminal end for receiving a plurality of curtain hangers.

4. The combined mount and curtain rod device of claim 3, wherein said free terminal end of said first rod member extending beyond said first end of said mounting plate.

5. The combined mount and curtain rod device of claim 4, wherein said free terminal end of said second rod member extending beyond said second end of said mounting plate.

6. The combined mount and curtain rod device of claim 3, wherein said at least three apertures disposed at a midpoint between a top edge and a bottom edge of said mounting plate.

7. The combined mount and curtain rod device of claim 3, wherein said second planar member parallel to said fourth planar member.

8. The combined mount and curtain rod device of claim 7, wherein said first planar member coplanar with said third planar member.

9. The combined mount and curtain rod device of claim 8, wherein said mounting plate is planar.

10. The combined mount and curtain rod device of claim 9, wherein said mounting plate is rectangular.

11. The combined mount and curtain rod device of claim 10, wherein said first rod member and said second rod member are transparent.

12. The combined mount and curtain rod device of claim 11, wherein said mounting plate having a first width, and said first rod member and said second rod member having a second width, and further wherein said first width is greater than said second width.

13. A combined mount and curtain rod device comprising:
a mounting plate having a rear surface and an opposing front surface including at least three apertures;
at least three fasteners;
a first L-bracket;
a second L-bracket;
a first rod member; and
a second rod member;
wherein at least one aperture of the at least three apertures disposed through said mounting plate proximal to a first end, at least a second aperture of the at least three apertures disposed through said mounting plate proximal to a second end, and a third aperture of the at least three apertures disposed proximal to a center of said mounting plate;
wherein each one of said at least three apertures having at least one of said at least three fasteners therethrough for mounting said mounting plate to a wall;
wherein said first L-bracket mounted proximal to a first side of said third aperture and said second L-bracket mounted proximal to an opposing side of said third aperture;
wherein said first L-bracket having a first planar member affixed to said front surface of said mounting plate;
wherein said first L-bracket having a second planar member transverse to said first planar member extending transversely and outwardly from said front surface of said mounting plate;
wherein said second L-bracket having a third planar member affixed to said front surface of said mounting plate;

wherein said second L-bracket having a fourth planar member transverse to said third planar member extending transversely and outwardly from said front surface of said mounting plate;

wherein said second planar member and said fourth planar member having a space therebetween;

wherein said first rod member at a first end attached to said second planar member of said first L-bracket and extends parallel to said mounting plate;

wherein said second rod member at a first end attached to said fourth planar member of said second L-bracket and extends parallel to said mounting plate;

wherein said second planar member parallel to said fourth planar member; and further wherein said first planar member coplanar with said third planar member.

14. The combined mount and curtain rod device of claim 13, wherein said first rod member at a second end is a free terminal end for receiving a plurality of curtain hangers.

15. The combined mount and curtain rod device of claim 14, wherein said second rod member at a second end is a free terminal end for receiving a plurality of curtain hangers.

16. The combined mount and curtain rod device of claim 15, wherein said free terminal end of said first rod member extending beyond said first end of said mounting plate.

17. The combined mount and curtain rod device of claim 16, wherein said free terminal end of said second rod member extending beyond said second end of said mounting plate.

18. The combined mount and curtain rod device of claim 17, wherein said first rod member and said second rod member are transparent.

19. The combined mount and curtain rod device of claim 18, wherein said mounting plate having a first width, and said first rod member and said second rod member having a second width, and further wherein said first width is greater than said second width.

20. A combined mount and curtain rod device comprising:

a mounting plate having a rear surface and an opposing front surface including at least three apertures;

at least three fasteners;

a first L-bracket;

a second L-bracket;

a first rod member; and a second rod member;

wherein at least one aperture of the at least three apertures disposed through said mounting plate proximal to a first end, at least a second aperture of the at least three apertures disposed through said mounting plate proximal to a second end, and a third aperture of the at least three apertures disposed proximal to a center of said mounting plate;

wherein each one of said at least three apertures having at least one of said at least three fasteners therethrough for mounting said mounting plate to a wall;

wherein said first L-bracket mounted proximal to a first side of said third aperture and said second L-bracket mounted proximal to an opposing side of said third aperture;

wherein said first L-bracket having a first planar member affixed to said front surface of said mounting plate;

wherein said first L-bracket having a second planar member transverse to said first planar member extending transversely and outwardly from said front surface of said mounting plate;

wherein said second L-bracket having a third planar member affixed to said front surface of said mounting plate;

wherein said second L-bracket having a fourth planar member transverse to said third planar member extending transversely and outwardly from said front surface of said mounting plate;

wherein said second planar member and said fourth planar member having a space therebetween;

wherein said first rod member at a first end attached to said second planar member of said first L-bracket and extends parallel to said mounting plate;

wherein said second rod member at a first end attached to said fourth planar member of said second L-bracket and extends parallel to said mounting plate;

wherein said first rod member at a second end is a free terminal end for receiving a plurality of curtain hangers;

wherein said second rod member at a second end is a free terminal end for receiving a plurality of curtain hangers;

wherein said free terminal end of said first rod member extending beyond said first end of said mounting plate; and further wherein said free terminal end of said second rod member extending beyond said second end of said mounting plate.

* * * * *